United States Patent [19]

Wharton

[11] Patent Number: 4,988,315

[45] Date of Patent: Jan. 29, 1991

[54] ELECTRICAL ADAPTER PLUG

[75] Inventor: Richard F. Wharton, Glenview, Ill.

[73] Assignee: SAFCO Corporation, Chicago, Ill.

[21] Appl. No.: 482,771

[22] Filed: Feb. 21, 1990

[51] Int. Cl.[5] ..... H01R 17/18

[52] U.S. Cl. ..... 439/668; 439/675

[58] Field of Search ..... 439/825, 826, 668, 669, 439/677, 678, 679, 675, 638

[56] References Cited

U.S. PATENT DOCUMENTS 2,489,037 11/1949 Kailer ..... 439/668

FOREIGN PATENT DOCUMENTS 1166317 3/1964 Fed. Rep. of Germany ..... 439/679

*Primary Examiner*—David L. Pirlot

*Attorney, Agent, or Firm*—Augustus G. Douvas

[57] ABSTRACT

An electrical adapter plug having a body insertable into a mating socket sleeve of a vehicle lighter receptacle. The plug features a pair of ideally located circumferentially-spaced, retractable contacts projecting beyond the periphery of the plug body to establish improved retention and electrical contact between the adapter plug and the receptacle. The two contacts are preferably angularly spaced on the periphery of the plug in the range of about 20° to 150°. Means are located on the periphery of the plug body generally opposite the pair of contacts symmetrically disposed on or about a line which bisects the space angle between the two contacts. Three different embodiments of these means are shown, namely, a groove, a flat surface, and an elongated deformation. All of these embodiments cooperate with the spaced contacts to improve retention.

15 Claims, 3 Drawing Sheets

ELECTRICAL ADAPTER PLUG

BACKGROUND OF THE INVENTION

This invention relates to electrical connecting devices, and particularly to an electrical adapter plug which may be inserted into the sockets or receptacles of automotive cigarette lighter assemblies so that various low voltage loads may be operated by the electrical system of the vehicle.

In recent years, a great variety of electrical appliances have become available for operation by the low voltage, direct-current power of the electrical systems of cars, power boats, and campers. The appliance is generally interconnected to the electrical system of the vehicle by use of an adapter plug or connector which is inserted into the cigarette lighter socket or receptacle. Electrical appliances and accessories which can be operated from a vehicle electrical system vary widely and include portable television sets, tape recorders, trouble lights, window defrosters, electric shavers, electric toothbrushes, can openers, food mixers, and the like.

Such prior art devices useful for electrical connection with cigarette lighter receptacles include Focosi U.S. Pat. No. 2,954,544, Schwartz U.S. Pat. No. , 3099,505, Busch et al. U.S. Pat. No. 3,377,610 and Busch U.S. Pat. No. 3,865,463.

In general, existing adapter plug designs each have one or two spring contacts mating with a receptacle sleeve. If there are two contacts, they are angularly spaced to project from the periphery of an adapter plug body at an angle of 180°. Accordingly, the vector sum of the mechanical forces of two contacts within the sleeve are in-line or 180° opposing and there is zero force on the body of the adapter plug to position it against the receptacle surface. Thus the adapter plug is able to pivot on the in-line contact points within the receptacle. When the adapter plug is free to pivot more, it can loosen and eventually lose electrical contact when subject to vibration or shock.

SUMMARY OF THE INVENTION

A principal object of this invention is to greatly improve the retention of an adapter plug within a receptacle sleeve.

Another object of this invention is to attain a more reliable electrical connection between an adapter plug and its socket or retention sleeve in response to intense vibration or severe jarring.

The invention features a new and novel position for a pair of spaced electrical spring contacts located on the periphery of an adapter plug body. These contacts establish improved mating contact with the cylindrical sleeve of a cigarette lighter receptacle when the adapter plug is manually inserted into the receptacle. In particular, two negative or side contacts on the adapter plug are positioned to provide a force on the body of the adapter plug resulting in better contact engagement with the receptacle sleeve. The two spring contacts are radially positioned opposite each other at a included angle of less than 180°. The resultant vector force effects a peripheral contact of the adapter plug to the receptacle sleeve (and depending upon the particular preferred embodiment employed) a stable two point and a one line or alternatively a two line engagement of the mated adapter plug and receptacle sleeve.

In a first preferred embodiment effecting two line engagement, a groove is strategically located on the periphery of the adapter plug body diametrically opposite the electrical contacts and centered on a line which represents an extension of the resultant force vector generated by the two spring contacts. The two sidewall edges, which define the groove, make a spaced two-line contact with the receptacle sleeve.

Accordingly, the adapter plug makes contact with the sleeve of the receptacle in four areas, namely, the two lines which define the two edges of the groove and the two spring contact points. This four area mating contact between the adapter plug and its receptacle greatly improves the retention of the adapter plug in the receptacle.

Prior art adapter plug designs in commerce have one or two electrical spring contacts mating with the receptacle sleeve. If there are two contacts, they are 180° opposing.

This in-line disposition of forces enables the adapter plug to pivot on the in-line contact areas (or points) established with the receptacle. When the adapter plug is free to pivot or move, it can loosen and eventually break electrical contact when subjected to vibration or jarring.

In a second preferred embodiment of this invention, the periphery of the adapter plug body is formed with a protruding portion (the groove of the first embodiment is eliminated) diametrically opposite the electrical contacts and centered on a line which represents an extension of the resultant force vector generated by the two spring contacts. The resultant vector force effects contact of the adapter plug to the receptacle sleeve in three spaced areas, namely the two spaced spring contact points and the line of contact between the protruding portion and the receptacle sleeve.

A third preferred embodiment is also described which features a flat adapter-plug body portion (in lieu of a groove) to define two line contact areas which function similar to the groove edges.

DESCRIPTION OF THE DRAWINGS

In order that all of the structural features for attaining the objects of this invention may be readily understood, reference is herein made to the drawings wherein.

DETAILED DESCRIPTION OF THE PREFERRED EMBODIMENTS

Figure 1:
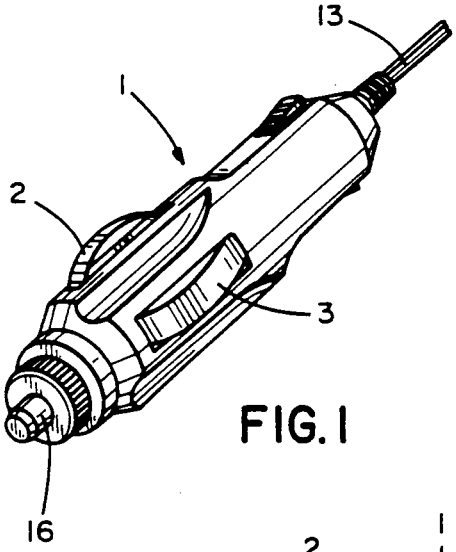
FIG. 1 is a perspective view of the adapter plug of this invention.
Figure 2:
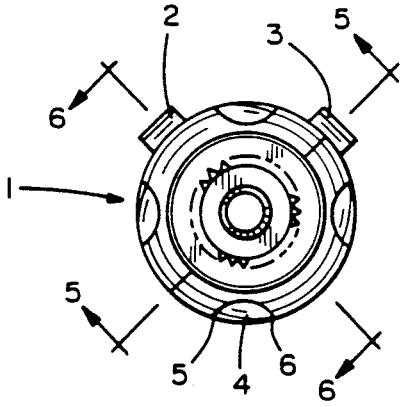
FIG. 2 is an elevation view of the positive-contact end of the adapter plug.
Figure 3:
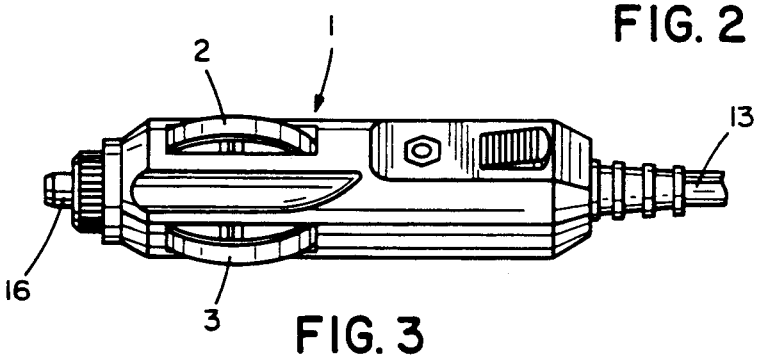
FIG. 3 is a side view of the adapter plug which shows the two spring side contacts.
Figure 4:
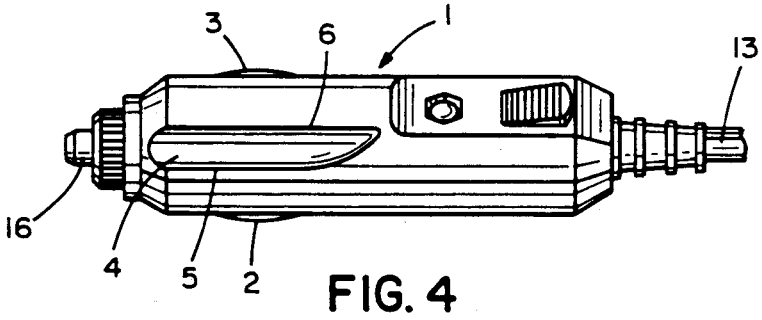
FIG. 4 is a side view of the adapter plug of a first preferred embodiment which shows a groove whose two edges make retention contact with the receptacle sleeve.
Figure 5:
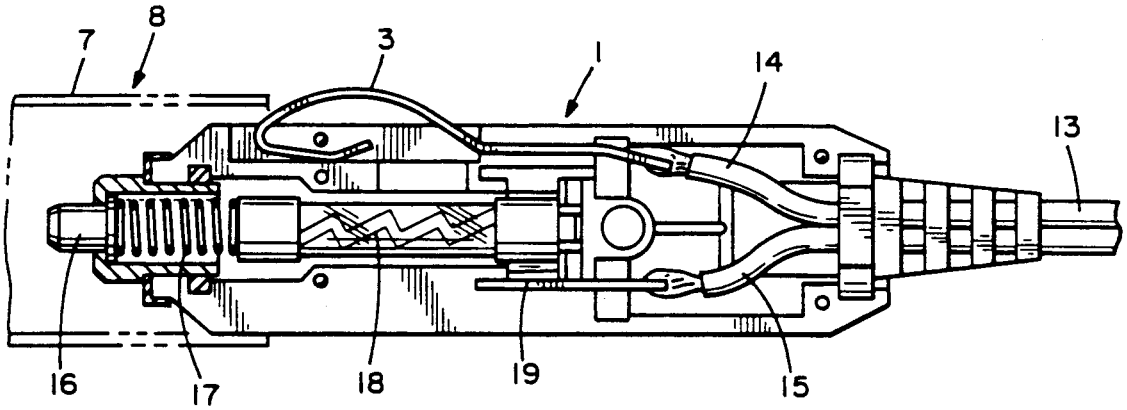
FIG. 5 is a section view taken along line 5-5 of FIG. 2 which shows certain details of the internal construction of the adapter plug.
Figure 6:
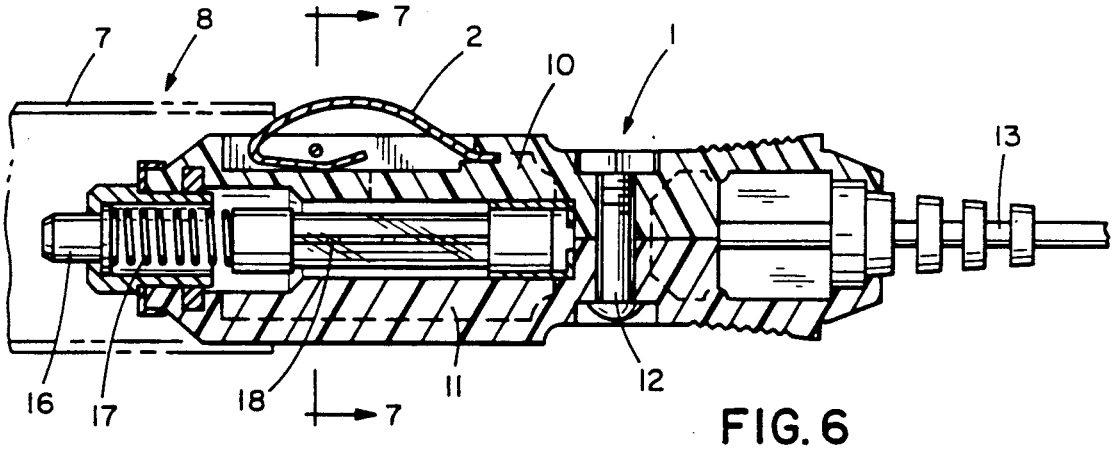
FIG. 6 is a section view taken along line 6-6 of FIG. 2 which shows additional details of the internal construction of the adapter plug.
Figure 7:
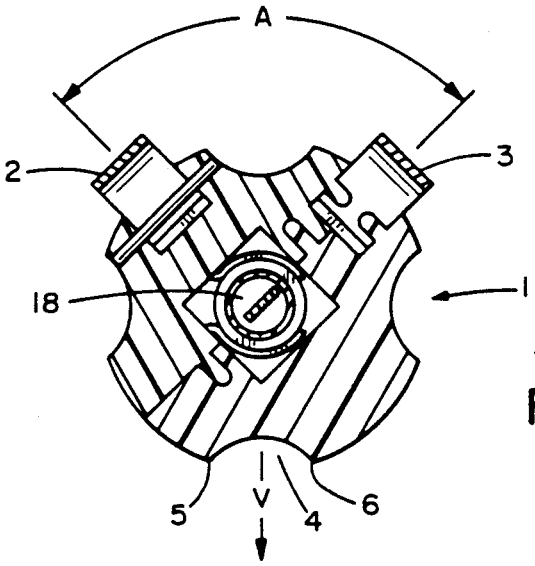
FIG. 7 is a section view taken along line 7-7 of FIG. 6 which shows the spring contacts in an expanded state which occurs when the adapter plug is removed from a receptacle.
Figure 8:
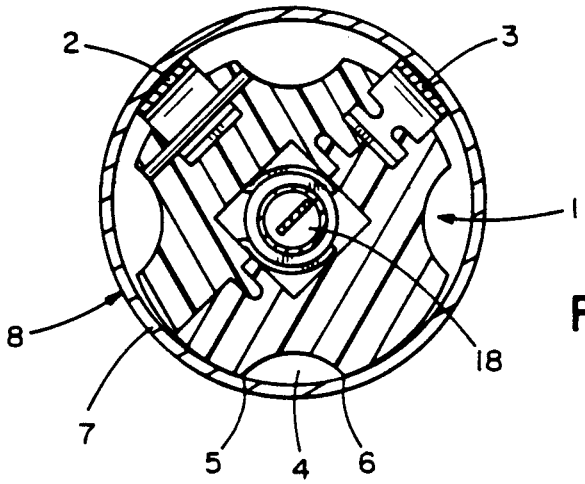
FIG. 8 is a section view related to FIG. 7 which shows the spring contacts in a compressed state which occurs when the adapter plug is inserted into a receptacle.

A first preferred embodiment of electrical adapter plug 1 of this invention is shown in FIGS. 1 through 8. The principal novel structural feature of this embodiment resides in the particular disposition of retractable spring contacts 2 and 3 relative groove 4 and elongated line edges 5 and 6 (FIGS. 2, 7 and 8).

When adapter plug 1 is inserted into socket sleeve 7 of receptacle 8 (FIGS. 5, 6 and 8), spring contacts 2 and 3 are retracted (FIG. 8) tightly mating adapter plug 1 within receptacle 8. With this action, four spaced areas of mating contact are effected between adapter plug 1 and receptacle 8. In particular, limited area contact (essentially "point" contact) is established between each spring contact element 2, 3 and socket sleeve 7, and elongated area contact (essentially "line" contact) is established between each groove edge 5, 6 and socket sleeve 7.

This four area mating contact between adapter plug 1 and its receptacle 8 greatly improves the retention of the adapter plug in the receptacle. Accordingly, intense vibration or jarring of adapter plug 1 is less apt to dislodge the adapter plug from socket sleeve 7.

Adapter plugs now in the prior art either have one or two electrical spring contacts engaging an associated receptacle. The retention obtained from a single contact is generally unsatisfactory in environments subject to severe shock. Similarly, while improved retention is obtained in designs employing two spring contacts, these contacts are disposed diametrically opposite one another on the periphery of the adapter plug body. This in-line disposition of spring forces generated by the 180° opposing spring contacts permits the adapter plug to pivot on the in-line spring contact areas (points) established with the receptacle. The result is a less than optimum retention which is only marginally satisfactory.

There are several important design parameters that govern the relative disposition of spring contacts 2, 3 and groove 4 defined by line edges 5, 6. The included angle A (FIG. 6) must be less than 180°, and preferably the angle should be in the range of about 20° to 150°.

In the first preferred embodiment, angle A is about 90°. As this angle is increased to greater than 90°, the resultant force vector V exerted against line edges 5, 6 is decreased; and as this angle is decreased the vector V is increased. However, in both cases substantial angle A deviations from 90° enables adapter plug 1 to pivot more easily due to decreased retention.

Groove 4 is optimally located on the periphery of adapter plug body 9 generally opposite electrical spring contacts 2, 3 so as to be centered on a force line V which represents an extension of the resultant force vector generated by the two spring contacts 2, 3 when mated with socket sleeve 7. Groove 4 is generally aligned lengthwise with the longitudinal axis of the plug.

The remaining portion of adapter plug 1 is generally conventional. Plug body 9 is formed in two plastic sections 0, 11 joined together by bolt 12 (FIG. 6). Power outlet cord 13 has a pair of conductors 14, 15 (FIG. 5). Conductor 14 is connected to one or both of spring contacts 2, 3; and therefore according to conventional United States practice it is the negative conductor. Conductor 15 is connected to retractable positive nose contact 16 through helical spring 17, cartridge fuse 18 and fuse socket element 19; and therefore it is the positive conductor.

Figure 9:
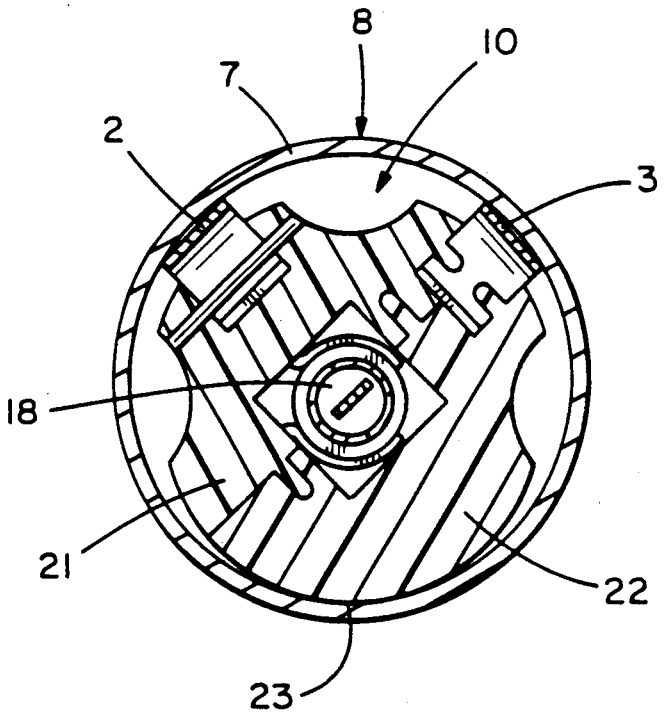
FIG. 9 is a section view of the second preferred embodiment of the adapter plug of this invention (featuring a single projecting portion in lieu of a groove) which shows the spring contacts in a compressed state.

A second preferred embodiment of this invention is shown in the cross-section view of FIG. 9. In this configuration, adapter plug 20 is formed with two joined plastic body sections 21, 22. The periphery of the resulting plug body omits groove 4 of the first embodiment and is contoured to define an elongated projection 23 generally aligned lengthwise with the longitudinal axis of the plug. In this embodiment, three district areas of mating contact are established between adapter plug 20 and socket sleeve 7. In particular, point contacts are established by spring contacts 2, 3 and a single line contact is formed by elongated projection 23. The retention provided by the second embodiment is somewhat less than that provided by the first embodiment, but it is satisfactory for applications not involving severe shock.

Figure 10:
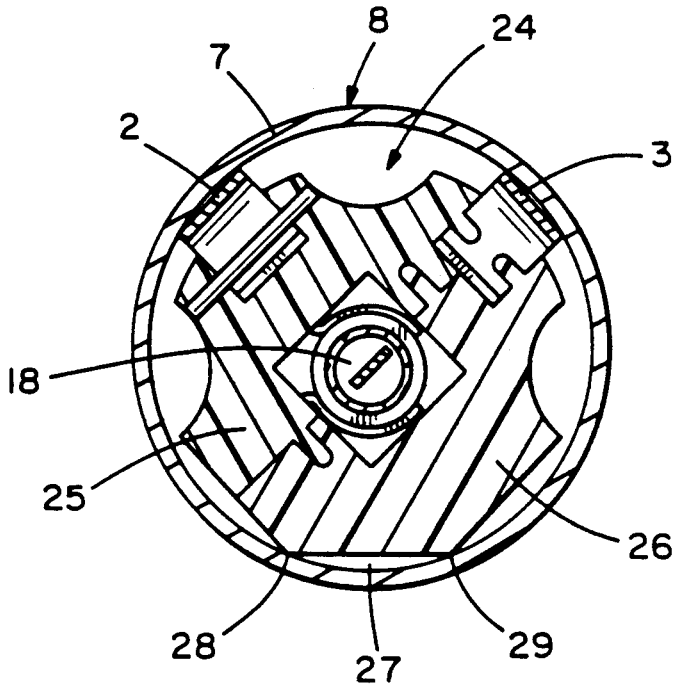
FIG. 10 is a section view of a third preferred embodiment employing a flat adapter-plug body portion (in lieu of a groove) to define two line contact areas.

A third preferred embodiment of this invention is shown in the cross-section view of FIG. 10. In this configuration, adapter plug 24 is formed with two joined plastic body sections 25, 26. Body section 26 is formed with a flat portion 27 defined by two elongated line edges 28, 29. These edges are aligned with the longitudinal axis of the adapter plug.

Edges 28, 29 make two area line contact with socket sleeve 7 when adapter plug 24 is inserted within receptacle 8. The four area contact provided by the third embodiment of FIG. 10 functions to provide plug retention in a manner which is essentially identical to that provided by groove edges 5, 6 of the first embodiment.

It should be understood that the above structures are merely illustrative of the preferred embodiments of this invention. Changes can be made without departing from the scope of the invention.

The essential requirement is that the adapter plug design employ angularly spaced point contacts effected by at lease a pair of retractable spring contacts. These point contacts must cooperate with one or two line contacts located either generally on (in the case of one line), or in the case of two spaced lines preferably symmetrically disposed, with respect to a diametrically extended line which bisects the angle between the two spaced contacts. This extended line also represents the resultant force vector generated by the two spring contacts.

What is claimed is:

1. An electrical adapter plug having a body insertable into a mating socket sleeve to establish electrical contact between the plug and the sleeve, comprising a pair of circumferentially spaced and retractable contacts projecting beyond the periphery of the plug body to establish electrical contact between at least one contact and the sleeve in response to a retraction of the contacts and with the two contacts being angularly spaced circumferentially on the periphery of the plug less than about 150°, and a groove located on the periphery of the adapter plug body generally opposite the pair of contacts and generally centered on a line which represents an extension of the resultant force vector generated by the restriction of the two spring contacts in response to the insertion of the adapter plug into the mating socket sleeve so that at least three areas of contact exist between the adapter plug and the sleeve and with the groove having edges making circumferentially spaced line contact with the socket sleeve when the plug is inserted into the socket sleeve.

2. The adapter plug of claim 1 in which the groove is aligned with the longitudinal axis of the plug.

3. The adapter plug of claim 1 in which the two contacts are angularly spaced more than about 20°.

4. The adapter plug of claim 3 in which the two contacts are angularly spaced about 90°.

5. An electrical adapter plug having a body insertable into a mating socket sleeve to establish electrical contact between the plug and the sleeve, comprising a pair of circumferentially spaced and retractable contacts projecting beyond the periphery of the plug body to establish electrical contact between at least one contact and the sleeve in response to a retraction of the contacts and with the two contacts being angularly spaced circumferentially on the periphery of the plug less than 180°, and an elongated projection generally aligned with the longitudinal axis of the plug with the projection being located on the periphery of the adapter plug body generally opposite the pair of contacts and generally centered on a line which represents an extension of the resultant force vector generated by the retraction of the two spring contacts in response to the insertion of the adapter plug into the mating socket sleeve so that at least three areas of contact exist between the adapted plug and the sleeve.

6. The adapter plug of claim 5 in which the two contacts are angularly spaced less than about 150°.

7. The adapter plug of claim 1 in which the two contacts are angularly spaced more than about 20°.

8. The adapter plug of claim 1 in which the two contacts are angularly spaced about 90°.

9. An electrical adapter plug having a body insertable into a mating socket sleeve to establish electrical contact between the plug and the sleeve, comprising a pair of circumferentially spaced contacts projecting beyond the periphery of the plug body to establish electrical contact between at least one contact and the sleeve in response to a retraction of the contacts and with the two contacts being angularly spaced circumferentially on the periphery of the plug less than 180°, and a groove located on the periphery of the adapter plug body generally centered on a line which represents an extension of the resultant force vector generated by the retraction of the two spring contacts in response to the insertion of the adapter plug into the mating socket sleeve so that at least three areas of contact exist between the adapter plug and the sleeve and with the groove having edges making circumferentially spaced line contact with the socket sleeve when the plug is inserted into the socket sleeve.

10. An electrical adapter plug having a body insertable into a mating socket sleeve to establish electrical contact between the plug and the sleeve, comprising a pair of circumferentially spaced contacts projecting beyond the periphery of the plug body to establish electrical contact between at least one contact and the sleeve in response to a retraction of the contacts and with the two contacts being angularly spaced circumferentially on the periphery of the plug less than 180°, and an elongated projection located on the periphery of the adapter plug body generally aligned with the longitudinal axis of the plug and centered on a line which represents an extension of the resultant force vector generated by the retraction of the two spring contacts in response to the insertion of the adapter plug into the mating socket sleeve so that at least three areas of contact exist between the adapter plug and the sleeve.

11. The adapter plug of claim 10 in which the two contacts are angularly spaced less than about 150°.

12. The adapter plug of claim 11 in which the two contacts are angularly spaced more than about 20°.

13. The adapter plug of claim 12 in which the two contacts are angularly spaced about 90°.

14. An electrical adapter plug having a body insertable into a mating socket sleeve to establish electrical contact between the plug and the sleeve, comprising a pair of circumferentially spaced contacts projecting beyond the periphery of the plug body to establish electrical contact between at least one contact and the sleeve in response to a retraction of the contacts and with the two contacts being angularly spaced circumferentially on the periphery of the plug less than 180°, and a projecting adapter plug body portion located on the periphery of the adapter plug body and generally narrowly centered on a diametrically extended line which bisects the angle between the two circumferentially spaced contacts so that the resultant force vector generated by the two spring contacts in response to the insertion of the adapter plug into the mating socket sleeve establishes at least three areas of spaced contact between the adapter plug and the sleeve with one or more of said areas of spaced contact being established by the projecting adapter plug body portion.

15. The adapter plug of claim 14 in which the projecting adapter plug body portion is defined by two spaced elongated edges separated by a relatively flat body section.

* * * * *